US012203732B2

(12) United States Patent
Salmon

(10) Patent No.: US 12,203,732 B2
(45) Date of Patent: Jan. 21, 2025

(54) GRENADE WITH INDEPENDENTLY DETACHABLE CARPEL SEGMENTS

(71) Applicant: Carl Salmon, Brooklyn, NY (US)

(72) Inventor: Carl Salmon, Brooklyn, NY (US)

( * ) Notice: Subject to any disclaimer, the term of this patent is extended or adjusted under 35 U.S.C. 154(b) by 124 days.

(21) Appl. No.: 17/753,765

(22) PCT Filed: Sep. 14, 2020

(86) PCT No.: PCT/US2020/050647
§ 371 (c)(1),
(2) Date: Mar. 14, 2022

(87) PCT Pub. No.: WO2021/118666
PCT Pub. Date: Jun. 17, 2021

(65) Prior Publication Data

US 2022/0373310 A1 Nov. 24, 2022

Related U.S. Application Data

(60) Provisional application No. 62/899,705, filed on Sep. 12, 2019.

(51) Int. Cl.
*F42B 12/22* (2006.01)
*F42B 12/36* (2006.01)
(Continued)

(52) U.S. Cl.
CPC ..... *F42B 12/22* (2013.01); *F42B 12/36* (2013.01); *F42B 27/08* (2013.01); *F42B 27/00* (2013.01);
(Continued)

(58) Field of Classification Search
CPC ..... F42B 12/22; F42B 12/36; F42B 27/08; F42B 27/00; F42B 30/04; F42C 14/02; F42C 15/20
See application file for complete search history.

(56) References Cited

U.S. PATENT DOCUMENTS 1,560,628 A * 11/1925 Wiley ..... F42B 27/00 102/487
2,005,053 A * 6/1935 Schlafer ..... F42C 9/10 102/269
(Continued)

OTHER PUBLICATIONS

ISR issued in PCT/US2020/050647 on Nov. 6, 2021.

*Primary Examiner* — Michelle Clement
(74) *Attorney, Agent, or Firm* — Andrew H. Berks

(57) ABSTRACT

Disclosed herein is a grenade with a plurality of independently detachable carpel segments each containing a charge and independently detonated from other carpel segments. The grenade may include a head section with a triggering mechanism, and a modular hollow core with a rod having an upward mechanical bias towards the head section, which may include a safety pin, lever, and pivot. When the pin is pulled, a lever can be released after timed delay, and the release of the lever allows the rod to advance upward, which triggers strike pins that strike a primer which ignites a propellent that ejects a carpel segment from the core. The propellent simultaneously ignites a fuse in the body of the carpel segment, and the fuse triggers a detonation of the main charge in the carpel. Timed delays on the fuse can be used to cause the carpel segments to detonate at different times.

4 Claims, 5 Drawing Sheets

(51) Int. Cl.

| | |
|---|---|
| ***F42B 27/00*** | (2006.01) |
| ***F42B 27/08*** | (2006.01) |
| ***F42B 30/04*** | (2006.01) |
| ***F42C 14/02*** | (2006.01) |
| ***F42C 15/20*** | (2006.01) |

(52) U.S. Cl.
CPC ..... *F42B 30/04* (2013.01); *F42C 14/02* (2013.01); *F42C 15/20* (2013.01)

(56) References Cited

U.S. PATENT DOCUMENTS 2,094,562 A * 9/1937 Lowy ..... F42B 12/20 102/368
2,714,353 A 1/1950 Greer
2,562,928 A * 8/1951 Lewis ..... F42C 14/02 102/261
3,402,665 A * 9/1968 Tarpley, Jr. ..... F42B 27/00 222/394
3,611,931 A * 10/1971 Bessey ..... F42B 12/62 102/393
3,726,226 A * 4/1973 Grandy ..... F42B 12/48 102/334
3,796,128 A * 3/1974 Zeyher ..... F41A 1/10 89/1.701
4,619,201 A * 10/1986 Romer ..... F42B 33/025 102/292
4,926,752 A * 5/1990 DiRubbio ..... F42C 14/02 102/202.13
5,196,649 A * 3/1993 DiRubbio ..... F42C 14/02 102/486
5,983,801 A * 11/1999 Brunn ..... F42B 12/48 102/336
6,595,139 B1 * 7/2003 Haeselich ..... F42B 27/00 102/482
7,712,419 B1 * 5/2010 Cheng ..... F42C 14/02 102/487
7,721,651 B2 * 5/2010 Lubbers ..... F42B 27/00 102/482
7,963,227 B1 * 6/2011 Brunn ..... F42B 27/00 102/482
8,365,668 B2 * 2/2013 Brunn ..... F42B 8/26 102/482
8,857,341 B1 * 10/2014 Andrews ..... F42C 15/188 102/486
9,255,777 B1 * 2/2016 Campagnuolo ..... F42C 14/02
9,261,339 B2 * 2/2016 Mancini ..... F42B 12/42
9,448,047 B1 * 9/2016 Domanico ..... F42B 27/00
9,470,495 B2 * 10/2016 Kravel ..... F42B 27/00
9,989,341 B2 * 6/2018 Robbins ..... F42B 27/00
11,054,231 B2 * 7/2021 Habel ..... F42B 4/16
2008/0156220 A1 * 7/2008 Tanguy ..... F42B 12/24 102/482
2012/0240806 A1 * 9/2012 Gonsalves ..... C06B 21/0041 102/275.11
2016/0305753 A1 10/2016 Moan et al.
2018/0259303 A1 9/2018 Salmon
2018/0259308 A1 * 9/2018 Salmon ..... F42C 14/02
2022/0373310 A1 * 11/2022 Salmon ..... F42B 12/22

* cited by examiner

GRENADE WITH INDEPENDENTLY DETACHABLE CARPEL SEGMENTS

CROSS-REFERENCE TO RELATED APPLICATIONS

This application claims benefit of U.S. Provisional Patent Application No. 62/899,705 filed Sep. 12, 2019, the disclosure of which is incorporated herein by reference in its entirety.

FIELD OF THE INVENTION

This invention pertains to a grenade in which a plurality of segments independently detach from a core and detonate independently.

BACKGROUND

A grenade is a small explosive weapon typically thrown by hand but can also refer to projectiles shot from grenade launchers. Generally, a grenade consists of an explosive charge, a detonating mechanism, and firing pin inside the grenade to trigger the detonating mechanism. The detonating mechanism usually includes a built-in delay to give a person (i.e., a soldier) time to throw the grenade a safe distance from the thrower. Once a soldier throws the grenade, the safety lever releases, the striker throws the safety lever away from the grenade body to detonate a primer. The primer explodes and ignites a fuse (sometimes called the delay element). The fuse burns down to the detonator, which explodes the main charge.

A common style of grenade is a fragmentation grenade, a lethal weapon designed to disperse shrapnel on detonation. These types of grenades detonate after either a time delay (typically about 4 seconds) from the release of the safety lever from the grenade body, or on impact. Other types of grenades are in use, including grenades used as anti-tank weapons, stun grenades, or smoke grenades or tear gas grenades. Thus, some types of grenades are not intended as lethal weapons.

SUMMARY OF THE INVENTION

Disclosed herein is a grenade with a plurality of independently detachable carpel segments wherein each carpel contains a charge, such as a lethal explosive charge or a non-lethal chemical charge such as a stun (i.e., a very loud noise or bright flash), tear gas, or smoke charge. In an embodiment, the grenade may include a head section with a triggering mechanism, and a modular hollow core with a rod wherein the rod has an upward bias i.e., a mechanical bias towards the head section. In an embodiment, the head section of the inventive grenade includes a safety pin, lever, and pivot. When the pin is pulled, a lever is released after timed delay, and the release of the lever allows the rod to advance upward. The advance of the rod triggers strike pins that strike a primer which ignites a propellent that ejects a carpel segment from the core. The propellent simultaneously ignites a fuse in the body of the carpel segment, such that the fuse triggers a detonation of the main charge in the carpel. Because each carpel segment is connected to a different strike pin, the carpels are independently ejected from one another. Timed delays on the fuse that detonates the main charge of a carpel can be used to cause the carpel segments to detonate at different times.

In an embodiment, a grenade is provided with independently detonatable segments. The grenade may include a head section defining a top of the grenade, where the head section has a removable locking pin and triggering mechanism comprising a lever, a spring, and a pivot. A modular segmented core may be provided, having one or more interlocking segments, wherein each core segment comprises a hollow tube with a rod positioned within the interior of each tube, and wherein each core segment is in mechanical communication with the core segments or sections on either end of the core segment, and the rod segments are connected to form a full-length rod. At least one spring positioned with the interior of at least one of the hollow tube segments exerts an upward bias on the full-length rod. The top of a first core segment is in mechanical communication with the head section, and a bottom of the last segment comprises a tail section defining a base of the grenade.

In an embodiment, the grenade further comprises two or more carpel segments surrounding the core, wherein each carpel spans from the head section to the tail section, and wherein each carpel comprises a charge detonatable by a fuse, such that each carpel segment is independently detonated, and wherein each carpel segment is in mechanical communication with the core though a nipple and a primer.

In an embodiment, the head section contains a lever, a lever body, a pivot, a cantilever spring anchored around the pivot, and a safety pin such that the safety pins locks the lever into a safe position, and when the safety pin is removed and no manual pressure is applied to the lever, the lever and lever body swing upward from the force of the cantilever spring around the pivot axis after a timed delay determined by tension on the spring.

In an embodiment, the full-length rod extends into the head section and is in mechanical communication with the lever body, such that when the lever is swings around the pivot, the full-length rod moves upward under the bias force of the one or more springs, wherein the upward movement shifts a push plate that releases a strike pin corresponding to each carpel, wherein the strike pin impacts a primer charge on each carpel that ignites a propellent that causes the carpel to eject from the core, and wherein the propellent simultaneously ignites a fuse in each carpel segment. The fuse in each carpel segment causes the carpel segment to detonate after a timed delay of from about 0.1 seconds to 10 seconds.

The grenade may have three interlocking core segments. The charge in any carpel segment may be selected from a fragmentation explosive, or a chemical charge.

In an embodiment, the release of the lever is caused by the impact of the grenade on a hard surface.

DESCRIPTION OF THE DRAWINGS

In FIG. 6, the grenade is in a safe mode.

In FIG. 8, the grenade has been triggered and the detonation sequence has started.

DETAILED DESCRIPTION

Figure 1:
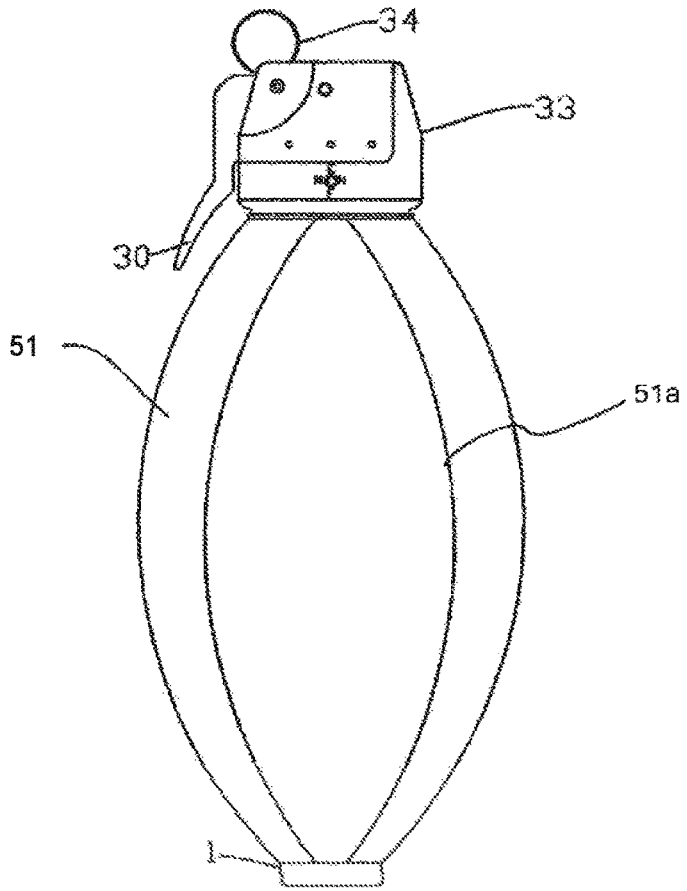
FIG. 1 is an elevation view of the exterior of a complete embodiment of this invention.

The inventive grenade is referred to herein as a "GUDID" grenade, which means "General Universal Detonating Integrated Device." As used herein, the terms "top," "higher," "upper," or "upward" refer to a direction toward the head section. The corresponding terms "bottom" or "lower" refer to a direction towards the base.

In an embodiment, this invention provides a grenade having a head section 33 defining a top of the grenade, where the head section has a removable locking pin 23 and a triggering mechanism comprising a lever 30 and trigger spring 40. The GUDID grenade further has a modular segmented hollow core shaft 5 comprising two or more interlocking segments marked 5*a*, 5*b*, and 5*c*, wherein each core shaft segment comprises a hollow tube with a rod 35 positioned within the interior of each shaft. In an embodiment as shown, core 5 is linked to head section 33 through head connector section 32 that forms the lower part of the head section. In an embodiment, each core segment 5*a*, 5*b*, and 5*c* is in mechanical communication with the core shaft segments on either end of the core segment and the highest section is connected to the head (or head connector section), and the last segment is in communication with a base section 1.

As illustrated in the figures, three core shaft segments (5*a*, 5*b*, and 5*c*) are shown. Rod segments 35*a*, 35*b*, and 35*c* are connected to rod extension 35*d*, which extends into the head section 33 and is in contact with lever body 31. Rod segments 35*a*-35*d* together form rod 35. Rod segments 35*a*-35*c* are supported within the hollow core shaft by supports 37. In an embodiment, one such support 37 is shown in each of segments 5*a*-5*c*.

Varying the core size means the overall size of the grenade can vary. For example, with one or two core segments, the overall size will be smaller than shown, which may be useful for lower powered main charges. Alternatively, with 4 or more core segments, the carpels may be larger, for larger main charges. Regardless of the number of core segments, at least one segment must correspond to segment 5*b* in the Figures, which has the strike pin mechanism.

In an embodiment, at least one rod bias spring 45 positioned with the interior of at least one of the hollow tube segments exerts an upward bias on the rod 35. In the safe (locked) state the rod 35 is thus stationary between the at least one bias spring 45 and the lever body 31. In the embodiment illustrated in the drawings, each core shaft segment has a spring 45.

The phrase herein "in communication" means two more mechanical components are mechanically linked so that a movement in one component in communication causes a corresponding movement in another component. Mechanically linked components may be connected, for example, with a flexible joint, with threads, or by any form of direct or indirect physical contact in which motion in one component causes a corresponding motion in another component.

Figure 11:
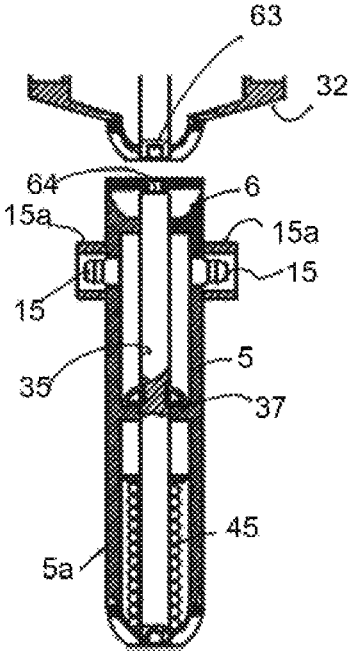
FIG. 11 is a detail view of segment 5*a*.
Figure 12:
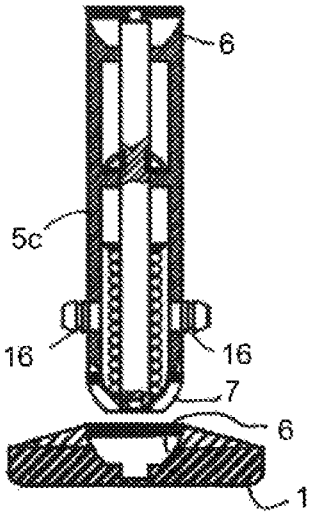
FIG. 12 is a detail view of segment 5*c* and the base 1.

In an embodiment, each shaft segment is connected to adjacent shaft segments or the head or base section by a threaded connector having external (male) threads 7 and internal (female) threads 6 (FIG. 12). Likewise, the rod segments 35*a*-*d* are connected by threaded connections having internal (female) threads 63 and external (male) threads 64 (FIG. 11).

In an embodiment, the top of a first core segment (5*a* as illustrated) is in mechanical communication with the head section 33, and a bottom of the last segment comprises a base section 1 defining a base of the grenade.

Figure 4:
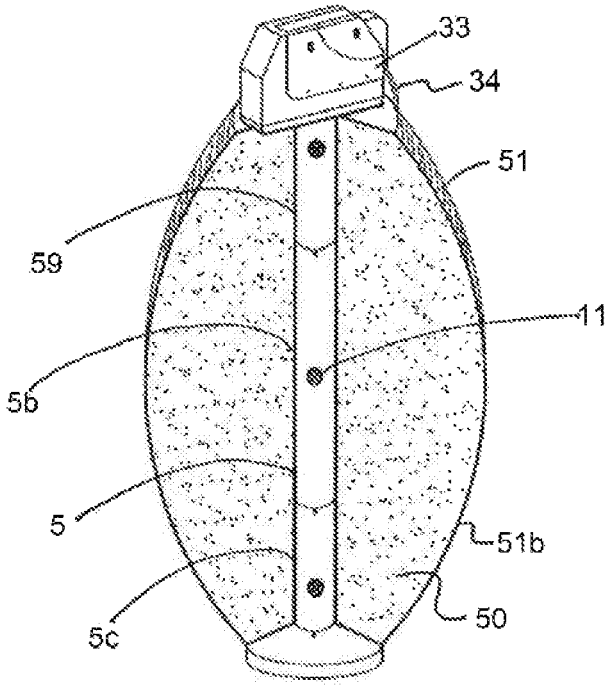
FIG. 4 is a sectional view of the GUDID grenade with one carpel removed.
Figure 5:
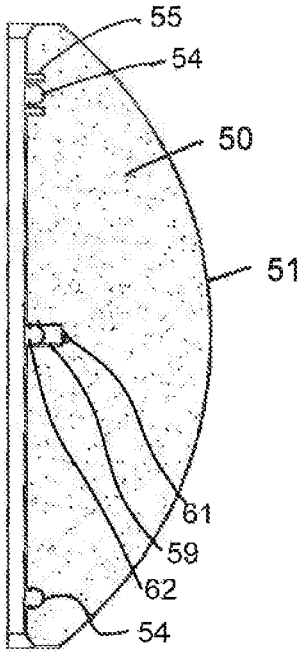
FIG. 5 is a side elevation view of a carpel.
Figure 6:
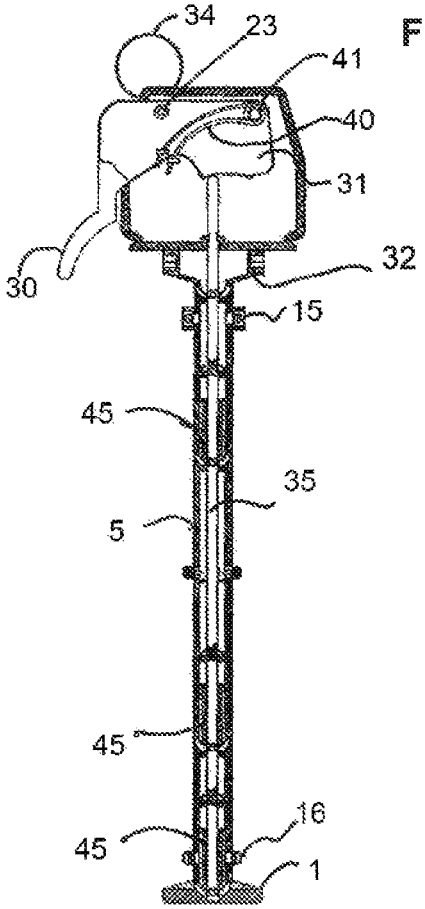
FIG. 6 is a cross section view of the head and core used to illustrate the triggering action.
Figure 7:
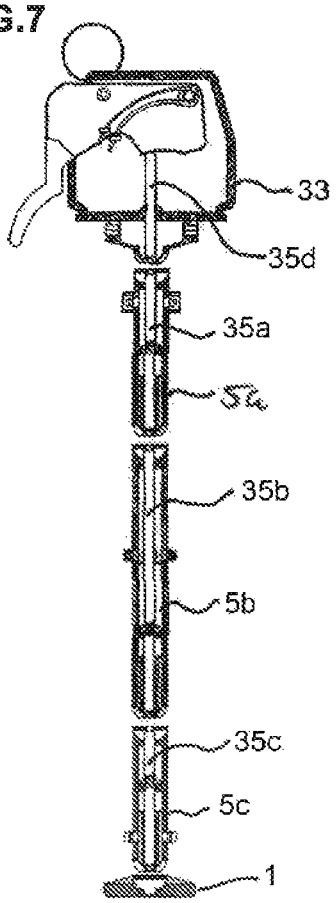
FIG. 7 is an exploded view showing the core segments separated, corresponding to FIG. 6.
Figure 8:
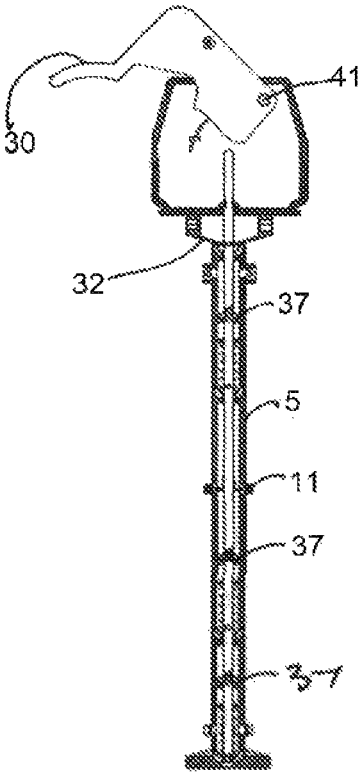
FIG. 8 is a cross section view of the head and core used to illustrate the triggering action.

In an embodiment, the GUDID grenade further comprises two or more carpel segments 51 surrounding the core 5 (FIGS. 3-5), wherein each carpel spans from the head section 33 to the base section 1, and wherein each carpel 51 comprises a charge 50 detonatable by a fuse 61, a propellent 59, and primer 62, such that each carpel is independently detonated, and wherein each carpel is in attached to the core shaft though an upper attachment nipple 15 and a lower attachment nipple 16. In the illustrated embodiment, upper and lower nipples 15 and 16 have different shapes so that the carpels are aligned correctly, with the top end adjacent to the head section and a lower end adjacent to the base segment 1. Attachment nipple 15 nests in nipple slot 54 and nipple slot guide 55 within the carpel. Attachment nipple 16 nests in a lower nipple slot 54 in the carpel (FIG. 5).

Figure 2:
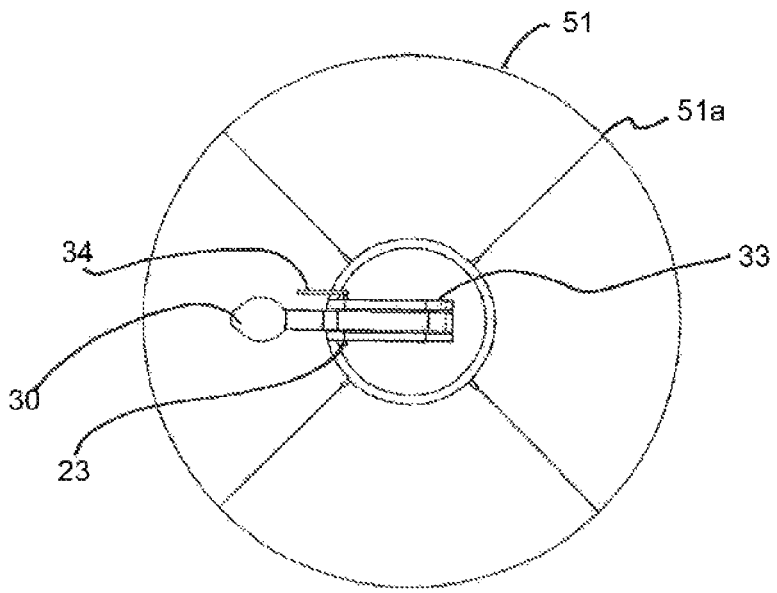
FIG. 2 is a top view of the exterior.
Figure 3:
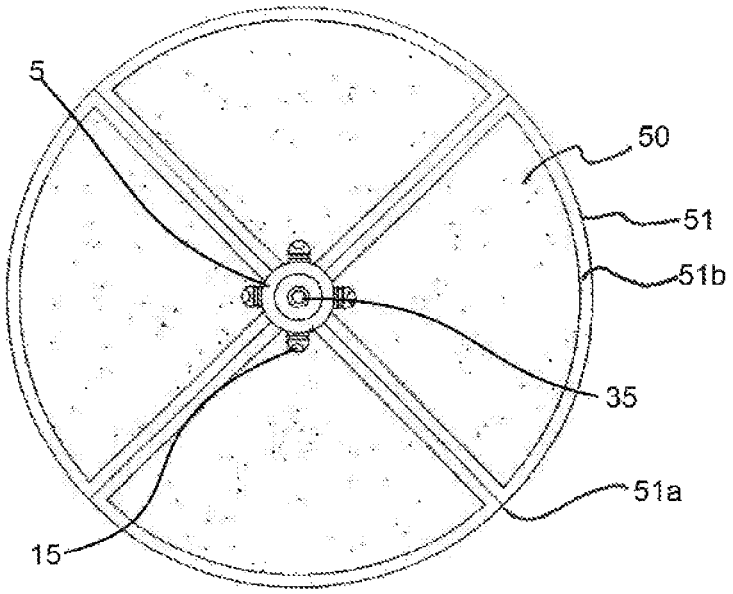
FIG. 3 is a s a cross section looking down through a latitudinal slice at the midpoint of the grenade between the head and tail sections.

The term "carpel" as used herein is analogous to the segments of a citrus fruit. This effect is illustrated in FIGS. 1-5. FIG. 1 is an elevation view of the GUDID grenade, showing the carpel segments spanning from the head section 33 to base 1. FIG. 2 is a top view showing an embodiment with four carpels and carpel boundaries 51*a*. FIG. 3 is a cross section looking down through a latitudinal slice at the midpoint of the grenade between the head and tail sections. Four carpels 51 are illustrated. Also shown are carpel shells 51*b*, that may be a supporting membrane that encloses and supports carpel charge 50, or (for example) a more functional shell intended to fragment on detonation. Also shown in FIG. 3 is core 5 and rod 35 and nipples 15.

In an embodiment, the head section 33 contains a lever 30, a lever body 31, a pivot 41, a cantilever spring 40 anchored around the pivot, and a safety pin or locking pin 23, such that the safety pin 23 locks the lever into a safe position, and when the safety pin is removed, the lever 30 and lever body 31 can swing upward around the pivot 41. Spring 40 is biased against lever 30, tending to force lever 30 upward into the triggered position. The movement of lever 30 is locked by safety pin 23. When the pin 23 is removed, a person holding the grenade must engage the lever 30 with their hand using manual pressure to prevent the lever from rotating about the pivot thereby triggering the grenade. When the person holding the grenade throws the grenade, the lever 30 is free to swing upward from the force of spring 40. The swinging and/or subsequent triggering of the GUDID is a then a function of the upward bias of rod 35 countered by spring 40. A typical delay in detonation is 4 seconds. When the lever and lever body swing upward around the pivot axis the rod 35 moves upward triggering subsequent detonation steps, termed herein the detonation sequence.

In an alternative embodiment, the lever rotation may be triggered by the impact of the grenade on a hard surface when thrown. In an embodiment in this alternative, spring 40 will not permit the lever body to rotate around the axis until it is jolted by the impact of the grenade thrown or shot onto a hard surface. The remaining steps of the triggering sequence are the same.

In an embodiment, the GUDID grenade of this invention can be launched from a rifle or rocket (rifle-propelled grenade or rocket-propelled grenade), rather than thrown by a person. In such an embodiment, the configuration of the lever 30 may vary. Lever 30 may be omitted entirely, but the detonation sequence would only initiate when the grenade impacted a surface after the trajectory from being fired from a rifle or rocket. Prior to firing, the safety pin would be removed, but the spring 40 would prevent detonation from commencing until the grenade impacted a surface.

Figure 9:
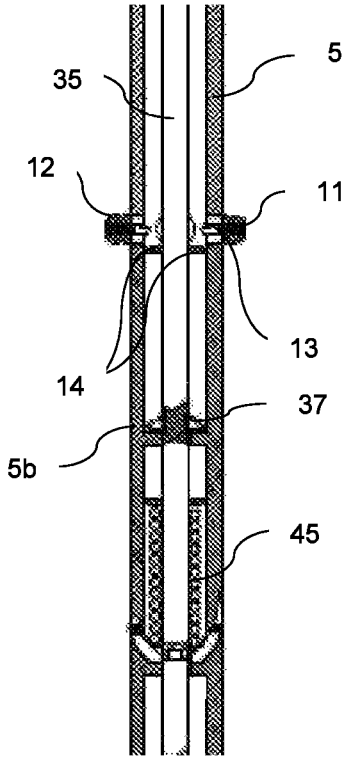
FIG. 9 is a detail view of segment 5*b* in the safe mode.
Figure 10:
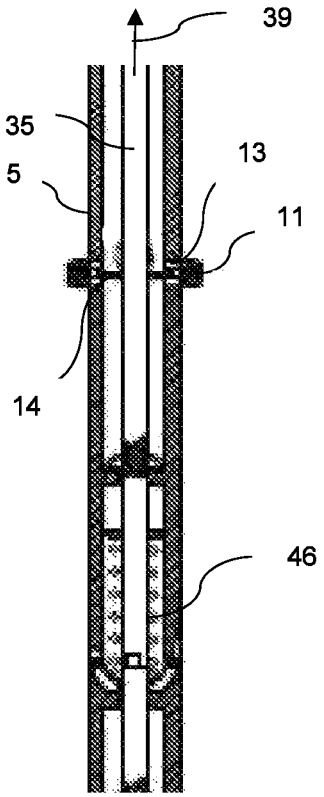
FIG. 10 is a detail view of segment 5*b* after triggering.

In an embodiment, full-length rod 35 extends into the head section 33 and is in mechanical communication with the lever body 31, such that when the lever swings around the pivot, the rod 35 moves upward under the bias force of the one or more bias springs 45. The movement of the rod is illustrated in FIGS. 9 and 10, showing rod bias spring 45 in FIG. 9, expanding to 46 shown in FIG. 10 when the rod 35 moves upward. The motion of rod 35 indicated by arrow 39.

In an embodiment, the detonation sequence starts with the upward movement of rod 35, which triggers a primer charge on each core segment that ejects the carpel segment in mechanical communication with that core segment, and simultaneously ignites a fuse in each carpel segment causing a carpel charge to detonate.

In an embodiment as illustrated, rod 35 shifts upward in the triggering sequence. This shift is towards head section 33 after lever body 31 swings around the pivot. This is illustrated in the transition of FIGS. 6 to 8 and FIGS. 9 to 10. Push plate 14 (FIGS. 9-10) is integral with rod 35 and shifts upward when rod 35 shifts in the triggering sequence. Push plate 14 shifts to the position shown in FIG. 10 when the triggering occurs. In FIG. 10, push plate 14 causes strike pins 13 to push outward, away from the core. The strike pins are within strike nipple 11. In an embodiment, the strike pins are driven forcefully outward (away from the core) by strike springs 12 that provide tension that is released when push plate 14 triggers the strike pins.

In an embodiment, the strike pins 13 impact primer 62 within a carpel (FIG. 5). Primer 62 has a small charge that detonates under pressure, analogous to the primer in a center-fire bullet cartridge. This primer ignites propellent 59 within the body of the carpel that has sufficient force to cause the carpel to detach from the core. At the same time, propellent 59 ignites fuse 61 that causes the main charge 50 in the carpel to detonate. In an embodiment, fuse 61 may have a delay, ranging from 0.1 to about 4 seconds, before the fuse detonates the main charge 50.

By varying a delay in each fuse 61 in a carpel segment, the detonation time of each charge 50 can be varied from about 0.1 seconds to 10 seconds.

Legend for Drawings

| Number | Description |
|---|---|
| 1 | Base (tail section) |
| 5 | Core shaft (hollow) |
| 5a | upper detachable cylindrical tubing |
| 5b | middle detachable cylindrical tubing |
| 5c | lower detachable cylindrical tubing |
| 6 | Internal (female) threads on core shaft segments |
| 7 | External (male) threads on core shaft segments |
| 11 | strike nipples |
| 12 | Strike pin springs |
| 13 | strike pins |
| 14 | push plate |
| 15 | Upper support nipples |
| 16 | Lower support nipple |
| 23 | lock pin |
| 30 | grip lever |
| 31 | Lever body |

-continued

Legend for Drawings

| Number | Description |
|---|---|
| 32 | Head connector section |
| 33 | Head section |
| 34 | pull ring |
| 35 | rod |
| 35a | Rod segments |
| 35b | Rod segments |
| 35c | Rod segments |
| 35d | Rod extension |
| 37 | Rod supports in core tubes |
| 39 | Rod movement arrow |
| 40 | Trigger spring |
| 41 | pivot |
| 45 | Rod bias springs |
| 46 | Rod bias spring expanded |
| 50 | Carpel charge |
| 51 | Carpel segment |
| 51a | Joint between carpel segments |
| 54 | nipple slot |
| 55 | Nipple guide |
| 59 | propellent |
| 61 | fuse |
| 62 | primer |
| 63 | Internal (female) threads on rod segments 35 |
| 64 | External (male) threads on rod segments 35 |

The invention claimed is:

1. A grenade with independently detonatable segments comprising:

a. a head section defining a top of the grenade, where the head section has a removable safety pin and triggering mechanism comprising a lever, a cantilever spring, and a pivot;

b. a modular segmented core comprising one or more interlocking segments, wherein each core segment comprises a hollow tube with a rod positioned within the interior of each tube, and wherein each core segment is in mechanical communication with the core segments or sections on either end of the core segment, and the rod segments are connected to form a full-length rod, and wherein at least one bias spring positioned with the interior of at least one of the hollow tube segments exerts an upward bias on the full-length rod;

c. wherein the top of a first core segment is in mechanical communication with the head section, and a bottom of the last segment comprises a tail section defining a base of the grenade;

d. wherein the grenade further comprises two or more carpel segments surrounding the core, wherein each carpel spans from the head section to the tail section, and wherein each carpel comprises a charge detonatable by a fuse, such that each carpel segment is independently detonated, and wherein each carpel segment is in mechanical communication with the core though a nipple and a primer;

e. wherein the head section safety pins locks the lever into a safe position, and when the safety pin is removed and no manual pressure is applied to the lever, the lever and lever body swing upward from the force of a cantilever spring around the pivot axis after a timed delay determined by tension on the cantilever spring;

f. Wherein the full-length rod extends into the head section and is in mechanical communication with the lever body, such that when the lever swings around the pivot, the full-length rod moves upward under the bias force of the at least one bias spring, wherein the upward movement shifts a push plate that releases a strike pin corresponding to each carpel, wherein the strike pin impacts a primer charge on each carpel that ignites a propellent that causes the carpel to eject from the core, and wherein the propellent simultaneously ignites a fuse in each carpel segment;

g. Wherein the fuse in each carpel segment causes the carpel segment to detonate after a timed delay of from about 0.1 seconds to 10 seconds.

2. The grenade of claim 1, wherein there are three interlocking core segments.

3. The grenade of claim 1, wherein the charge in any carpel segment is selected from a fragmentation explosive, or a chemical charge.

4. The grenade of claim 1, wherein the release of the lever is caused by the impact of the grenade on a hard surface.

* * * * *